US011585353B2

(12) United States Patent
Wang et al.

(10) Patent No.: US 11,585,353 B2
(45) Date of Patent: Feb. 21, 2023

(54) ROTATING GUIDE VANE MODULE FOR HYDRAULIC WORKING CONDITION ADJUSTMENT AND METHOD OF ASSEMBLING IN TURBOPUMP

(71) Applicants: Institute of Seawater Desalination and Multipurpose Utilization, MNR (Tianjin), Tianjin (CN); Tianjin Blue Cross Membrane Technology Co., Ltd., Tianjin (CN)

(72) Inventors: Shenghui Wang, Tianjin (CN); Sihan Liu, Tianjin (CN); Daiwang Song, Tianjin (CN); Chengpeng Wang, Tianjin (CN); Haitao Wang, Tianjin (CN); Yunfei Huang, Tianjin (CN); Guanhua Qiu, Tianjin (CN)

(73) Assignees: Institute of Seawater Desalination and Multipurpose Utilization, MNR (Tianjin), Tianjin (CN); Tianjin Blue Cross Membrane Technology Co. Ltd., Tianjin (CN)

( * ) Notice: Subject to any disclaimer, the term of this patent is extended or adjusted under 35 U.S.C. 154(b) by 257 days.

(21) Appl. No.: 17/006,322

(22) Filed: Aug. 28, 2020

(65) Prior Publication Data

US 2021/0062826 A1 Mar. 4, 2021

(30) Foreign Application Priority Data

Aug. 30, 2019 (CN) ..... 201910814680.3

(51) Int. Cl.
*F04D 29/46* (2006.01)
*F03B 3/18* (2006.01)
(Continued)

(52) U.S. Cl.
CPC ..... *F04D 29/466* (2013.01); *F03B 3/106* (2013.01); *F03B 3/183* (2013.01); *F04D 13/043* (2013.01);
(Continued)

(58) Field of Classification Search
CPC ..... F03B 3/106; F03B 3/183; F04D 29/2216; F04D 29/466; F04D 29/628; F05B 2210/403; F05B 2220/32; F05B 2220/602
See application file for complete search history.

(56) References Cited

U.S. PATENT DOCUMENTS 745,181 A * 11/1903 Harris ..... F04D 1/006 415/105
1,641,755 A * 9/1927 Gross ..... F03B 3/183 415/9

(Continued)

*Primary Examiner* — David E Sosnowski
*Assistant Examiner* — Aye S Htay
(74) *Attorney, Agent, or Firm* — Cesari & McKenna, LLP

(57) ABSTRACT

The present invention belongs to the technical field of fluid machinery, and proposes a rotating guide vane module for hydraulic working condition adjustment and a method of assembling in a turbopump. The rotating guide vane module comprises a rotating guide vane back cover plate, a rotating guide vane front cover plate, a rotating guide vane drive gear, and rotating guide vanes. Each rotating guide vane is an integrally-formed independent component and comprises a rotating guide vane back seat, a blade, a rotating guide vane front seat, and a shaft. When the rotating guide vane module for hydraulic working condition adjustment of the present invention is used for adjusting the hydraulic working condition, a center gear rotates to drive the rotating guide vane drive gear, and then the rotating guide vanes rotate to change their opening degrees.

6 Claims, 7 Drawing Sheets

(51) Int. Cl.
*F04D 15/00* (2006.01)
*F04D 13/04* (2006.01)
*F03B 3/10* (2006.01)

(52) U.S. Cl.
CPC ..... *F04D 15/0038* (2013.01); *F05B 2210/11* (2013.01); *F05B 2210/403* (2013.01); *F05B 2220/32* (2013.01); *F05B 2220/602* (2013.01)

(56) References Cited

U.S. PATENT DOCUMENTS 1,706,372 A * 3/1929 Anderson ..... F03B 3/183 415/150
1,706,375 A * 3/1929 Brikner ..... F03B 3/183 415/164
1,728,435 A * 9/1929 Moody ..... F03B 3/183 415/161
1,822,778 A * 9/1931 Kaplan ..... F03B 3/14 415/141
1,823,624 A * 9/1931 Nagler ..... F03B 3/183 60/696
1,990,045 A * 2/1935 Martin ..... F03B 3/183 415/176
2,064,313 A * 12/1936 Moody ..... F03B 3/183 415/129
2,277,255 A * 3/1942 Rudert ..... F03B 3/183 251/297
3,007,628 A * 11/1961 Nichols ..... F03B 3/183 415/150
3,232,581 A * 2/1966 Swearingen ..... F01D 17/165 415/164
4,056,330 A * 11/1977 Lieber ..... F04D 29/466 415/910
4,372,731 A * 2/1983 Fonda-Bonardi ..... F03B 3/183 415/151
4,472,103 A * 9/1984 Yamagata ..... F03B 3/183 415/910
5,873,700 A * 2/1999 Ichikawa ..... F01D 17/162 415/164
8,491,257 B2 * 7/2013 Martin ..... F01D 17/16 415/163
9,394,806 B2 * 7/2016 Nowicki ..... F01D 17/16

* cited by examiner

ROTATING GUIDE VANE MODULE FOR HYDRAULIC WORKING CONDITION ADJUSTMENT AND METHOD OF ASSEMBLING IN TURBOPUMP

CROSS REFERENCE TO RELATED APPLICATIONS

This application claims priority to Chinese Application No. 201910814680.3, filed on Aug. 30, 2019, the content of this application being hereby incorporated by reference in its entirety.

TECHNICAL FIELD

The present invention belongs to the technical field of fluid machinery, and specifically, relates to a rotating guide vane module for hydraulic working condition adjustment and a method of assembling in a turbopump.

BACKGROUND

A pump and a turbine or a turbine-pump all-in-one machine (a turbopump for short) is an essential device for supercharging the medium or recovering the energy in the industry. However, the structure of the existing device has a certain limitation to working condition adjustment. Generally, the usage of different working conditions needs different models and specifications of the devices.

The turbopump combines the pump and the energy recovery device and is usually applied to the reverse osmosis seawater desalination system. However, the system needs different seawater desalination recovery rates. So, there are higher working condition adjustment requirements to the pump and the energy recovery device. The main recovery rate adjustment manner comprises a bypass adjustment manner (as shown in FIG. 1) and a needle valve adjustment manner (as shown in FIG. 2) in the prior art. In these two adjustment manners, the working condition adjustment is achieved by reducing the flow path of the high-pressure medium, causing that the structure of the device is more complex and the energy recovery rate cannot be guaranteed. The optimal manner is to use movable guide vanes to conduct the working condition adjustment. However, various structures of the movable guide vane cannot match with the structure of the pump or the energy recovery device. Furthermore, the currently issued patents only disclose their forms, but not clarify their specific application manners to the pump device.

SUMMARY

The present invention proposes a rotating guide vane module for hydraulic working condition adjustment and a method of assembling in a turbopump. The technical solution provided by the present invention can be applied to the reverse osmosis seawater desalination system, etc. The present invention can not only adjust the working condition without changing the device, but also expand the high efficiency area when applied to multiple working conditions.

The present invention is achieved by the following technical solutions:

A rotating guide vane module for hydraulic working condition adjustment comprises a rotating guide vane back cover plate, a rotating guide vane front cover plate, a rotating guide vane drive gear, and rotating guide vanes. The rotating guide vane back cover plate is ring-shaped, and the rotating guide vane front cover plate is ring-shaped.

Each rotating guide vane is an integrally-formed independent component and comprises a rotating guide vane back seat, a blade, a rotating guide vane front seat, and a shaft. The rotating guide vane back seat and the rotating guide vane front seat are cylindrical. The blade is sheet-shaped. The blade is located between the rotating guide vane back seat and the rotating guide vane front seat. The shaft is connected with the rotating guide vane front seat. The central axis of the rotating guide vane back seat, the central axis of the rotating guide vane front seat, and the central axis of the shaft are coaxial.

A first slot for mounting the rotating guide vanes is formed in the rotating guide vane back cover plate. Second slots for matching with the mounting of the rotating guide vane front seats and through holes for allowing the penetration of the shafts are formed in the rotating guide vane front cover plate. The rotating guide vane drive gear is located at the end parts of the shafts. A keyslot is formed in each shaft, and a rotating guide vane connecting key is inserted into the keyslot. The rotating guide vane drive gear is connected with the shafts through the keyslots and the rotating guide vane connecting keys.

A turbopump with the rotating guide vane module for hydraulic working condition adjustment comprises a center gear screw cap, a center gear, a turbine side cover plate, a turbine side cover plate sealing ring, the rotating guide vane module, a turbine volute locating pin hole, a device shell, bolts, an end face friction thrust bearing, a turbine impeller, a turbine volute module, a rotating guide vane locating pin hole, rotating guide vane front sealing rings, a rotating guide vane back sealing ring, a volute diversion block, and a turbine side inlet.

The device shell, the turbine volute module, the rotating guide vane module, the turbine impeller, and the end face friction thrust bearing are sequentially combined from the exterior to the interior. The turbine volute module is inserted into the inner side of the device shell. The rotating guide vane module is inserted into the inner side of the turbine volute module. The end face friction thrust bearing is located on the outer side of the turbine impeller. The turbine impeller and the end face friction thrust bearing form end face friction contact.

Through holes for allowing the penetration of the shafts are formed in the turbine side cover plate. The center gear and the center gear screw cap sequentially sleeve the outer wall of an outlet tube on the turbine side cover plate from the interior to the exterior. The center gear screw cap is tube-shaped. The inner wall of the center gear screw cap is threaded. The outer wall of the outlet tube of the turbopump is threaded. The inner wall of the rotating guide vane drive gear has sawteeth, and the center gear and the rotating guide vane drive gear match with each other in a meshing manner. The center gear screw cap is used for fixing the center gear.

The rotating guide vane front sealing rings are arranged on the rotating guide vanes and located on the two sides of the through holes in the rotating guide vane front cover plate to prevent the medium from leaking through the through holes.

The rotating guide vane back sealing ring is arranged on the rotating guide vane back cover plate to prevent a matching part of the rotating guide vane module and the device shell from leaking.

The turbine volute locating pin hole is respectively located in the turbine volute module and the device shell to achieve insertion, location and fixation of the turbine volute module by inserting a locating pin.

The rotating guide vane locating pin hole is respectively located in the rotating guide vane module and the device shell to achieve insertion, location and fixation of the rotating guide vane module by inserting a locating pin.

The turbine side cover plate is located and mounted on the device shell through the bolts, and the turbine side cover plate sealing ring is arranged on the turbine side cover plate to prevent the medium from leaking.

The present invention proposes the rotating guide vane module for hydraulic working condition adjustment and an application method of the module to the turbopump. In an adjusting process, the center gear screw cap is unscrewed; the center gear rotates to drive the rotating guide vane drive gear, and then the rotating guide vanes rotate to change their opening degrees. After the adjustment is completed, the center gear screw cap is screwed to press the center gear tightly in order to ensure synchronous fixation of the center gear and the rotating guide vanes. Under a variable working condition, through the turbine side inlet, a high-pressure medium sequentially flows through the volute diversion block, the turbine volute module, and the rotating guide vane module and drives the turbine impeller to generate the power. After decompression, the high-pressure medium flows out through the turbine side outlet.

Compared with the prior art, the present invention has the following beneficial effects:

a, Multiple sectors form the structure of the rotating guide vane drive gear; so, the driving force is higher, and a problem that the rotating guide vanes are too tight to be adjusted can be effectively avoided.

b, The gear driving manner is simple and effective and provides a specific implementation solution for a turbine manner of combining two hydraulic components such as the rotating guide vanes and the volute.

c, The rotating guide vanes can effectively meet the requirements of multiple working conditions of the pump, the turbine, and the turbopump applying the rotating guide vanes. To a different working condition, the whole device does not need to be changed. Additionally, the hydraulic high efficiency area of the device is expanded.

d, The adjustment and control manner of the rotating guide vanes is also simple and effective. The pump, the turbine, and the turbopump with the rotating guide vanes also have the attractive appearance and are convenient to use. The rotating guide vanes can be adjusted in real time without turning off the device.

The rotating guide vane module for hydraulic working condition adjustment adopted by the technical solution of the present invention has clear principle, mature technologies, and high maneuverability, can be applied to the reverse osmosis seawater desalination system, etc., can be used for adjusting the working condition without changing the device, and can further expand the high the high efficiency area when applied to multiple working conditions.

In the description of the present invention, it should be further noted that: unless expressly specified and defined otherwise, the term "connection" should be understood broadly. For example, "connection" may be fixed connection, detachable connection, or integral connection; may also be mechanical connection or electrical connection; may be direct connection or indirect connection through an intermediate component. A person of ordinary skill in the art may understand specific meanings of the foregoing terms in the present invention based on a specific situation.

The specific implementation manners of the present invention are further described in detail below with reference to the accompanying drawings.

BRIEF DESCRIPTION OF THE DRAWINGS

The accompany drawings constituting a part of the present invention provide further understanding of the present invention. The schematic embodiments of the present invention and description thereof are intended to be illustrative of the present invention and do not constitute an undue limitation of the present invention. Apparently, the accompanying drawings in the following description show merely some embodiments of the present invention, and a person of ordinary skill in the art may still derive other drawings from these accompanying drawings without creative efforts.

In the drawings.

Figure 1:
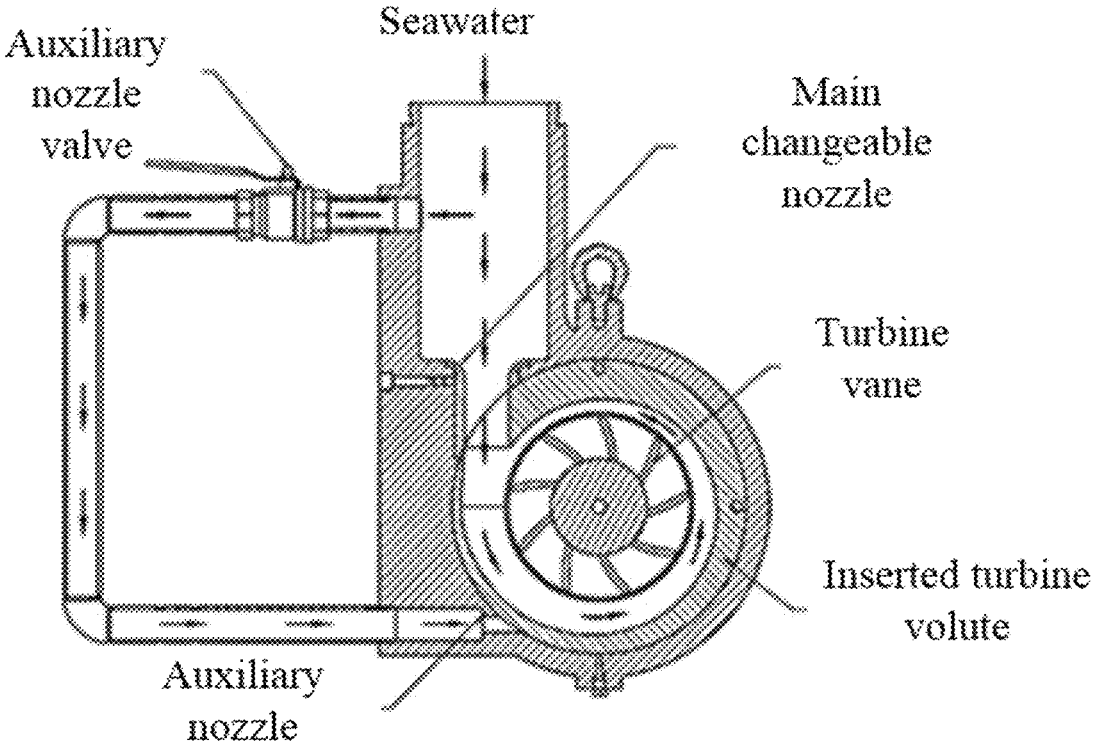
FIG. 1 Prior Art
FIG. 1 is a schematic diagram showing a bypass adjustment manner of recovery rate adjustment in the prior art.
Figure 2:
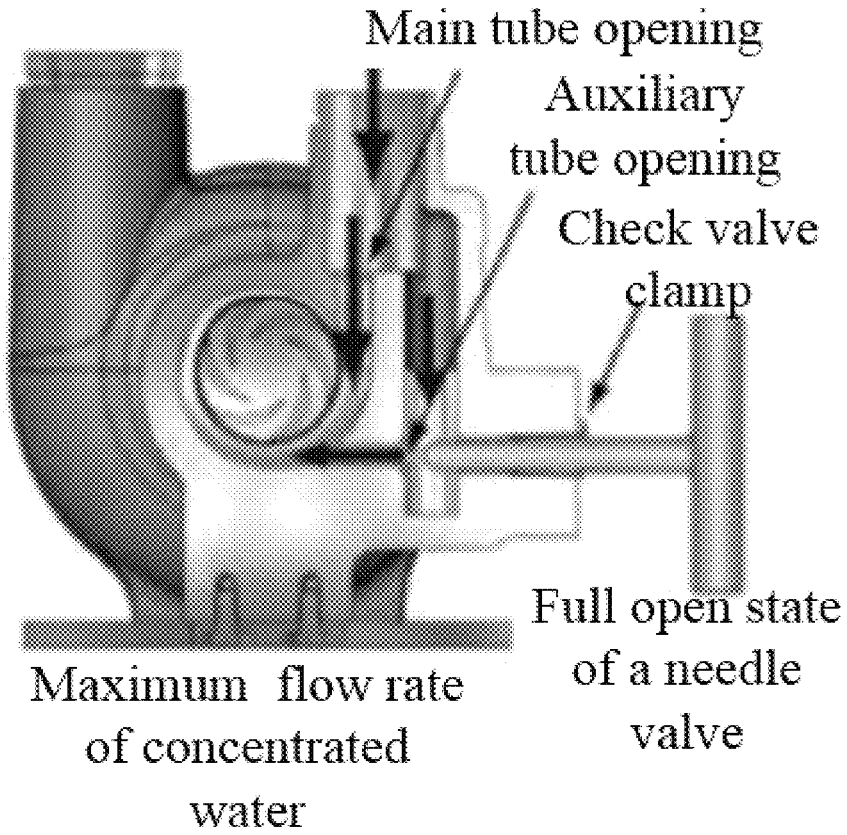
FIG. 2 Prior Art
FIG. 2 is a schematic diagram showing a needle valve adjustment manner of recovery rate adjustment in the prior art.

In the drawings: 1—rotating guide vane back cover plate, 2—rotating guide vane front cover plate, 3—rotating guide vane drive gear, 4—rotating guide vane, 5—rotating guide vane connecting key, 6—rotating guide vane back seat, 7—blade, 8—rotating guide vane front seat, 9—shaft, 10—center gear screw cap, 11—center gear, 12—turbine side cover plate, 13—turbine side cover plate sealing ring, 14—rotating guide vane module, 15—turbine volute locating pin hole, 16—device shell, 17—bolt, 18—end face friction thrust bearing, 19—turbine impeller, 20—turbine volute module, 21—rotating guide vane locating pin hole, 22—rotating guide vane front sealing ring, 23—rotating guide vane back sealing ring, 24—volute diversion block, 25—turbine side inlet, and 26—second slots.

It should be noted that these accompanying drawings and text description are not designed to limit the conception range of the present invention in any manners, but describe the concept of the present invention to those skilled in the art by referring to the specific embodiments.

DESCRIPTION OF THE EMBODIMENTS

To make the objectives, technical solutions, and advantages of the embodiments of the present invention clearer, the following clearly and completely describes the technical solutions in the embodiments of the present invention with reference to the accompanying drawings in the embodiments of the present invention. The following embodiments are for illustrative purposes and do not limit the scope of the present invention.

The following describes the specific embodiments of the present invention in detail with reference to the technical solutions and the accompanying drawings.

Figure 3:
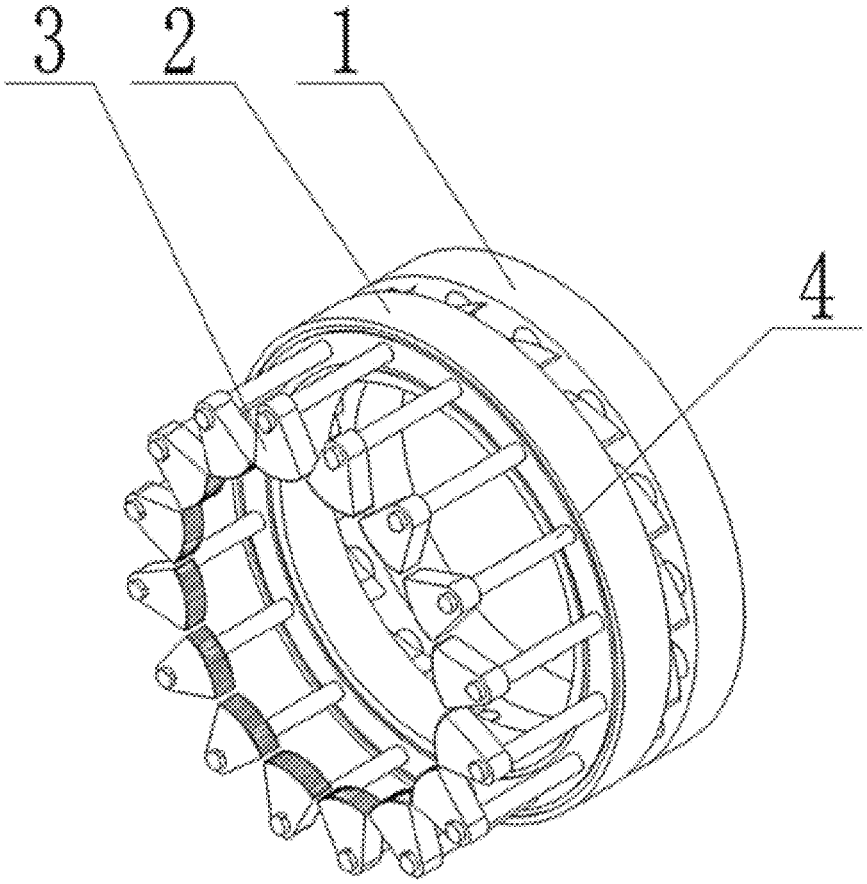
FIG. 3 is a schematic structural diagram of a rotating guide vane module.

Embodiment: as shown in FIG. 3, a rotating guide vane module for hydraulic working condition adjustment is proposed. The rotating guide vane module 14 comprises a rotating guide vane back cover plate 1, a rotating guide vane front cover plate 2, a rotating guide vane drive gear 3, and rotating guide vanes 4. The rotating guide vane back cover plate 1 is ring-shaped, and the rotating guide vane front cover plate 2 is ring-shaped.

Figure 4:
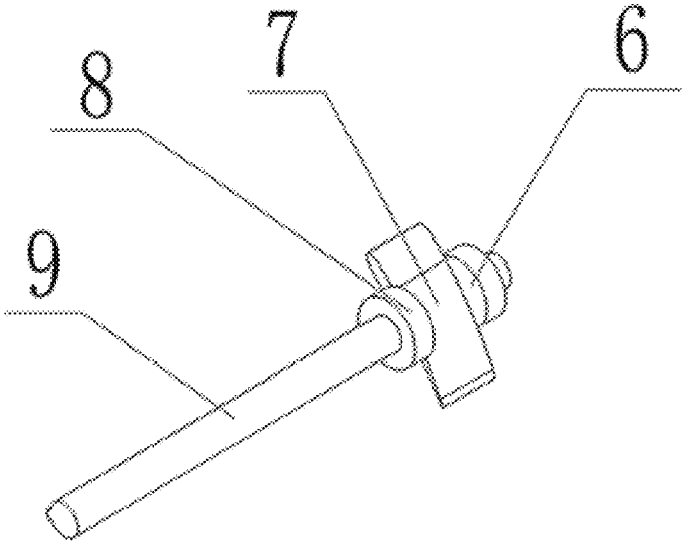
FIG. 4 is a schematic structural diagram of a rotating guide vane.

As shown in FIG. 4, each rotating guide vane 4 is an integrally-formed independent component and comprises a rotating guide vane back seat 6, a blade 7, a rotating guide vane front seat 8, and a shaft 9. The rotating guide vane back seat 6 and the rotating guide vane front seat 8 are cylindrical. The blade 7 is sheet-shaped. The blade 7 is located between the rotating guide vane back seat 6 and the rotating guide vane front seat 8. The shaft 9 is connected with the rotating guide vane front seat 8. The central axis of the rotating guide vane back seat 6, the central axis of the rotating guide vane front seat 8, and the central axis of the shaft 9 are coaxial.

A first slot for mounting the rotating guide vanes 4 is formed in the rotating guide vane back cover plate 1. Second slots 26 for matching with the mounting of the rotating guide vane front seats 8 and through holes for allowing the penetration of the shafts 9 are formed in the rotating guide vane front cover plate 2. The rotating guide vane drive gear 3 is located at the end parts of the shafts 9. A keyslot is formed in each shaft 9, and a rotating guide vane connecting key 5 is inserted into the keyslot. The rotating guide vane drive gear 3 is connected with the shafts 9 through the keyslots and the rotating guide vane connecting keys 5.

Figure 8:
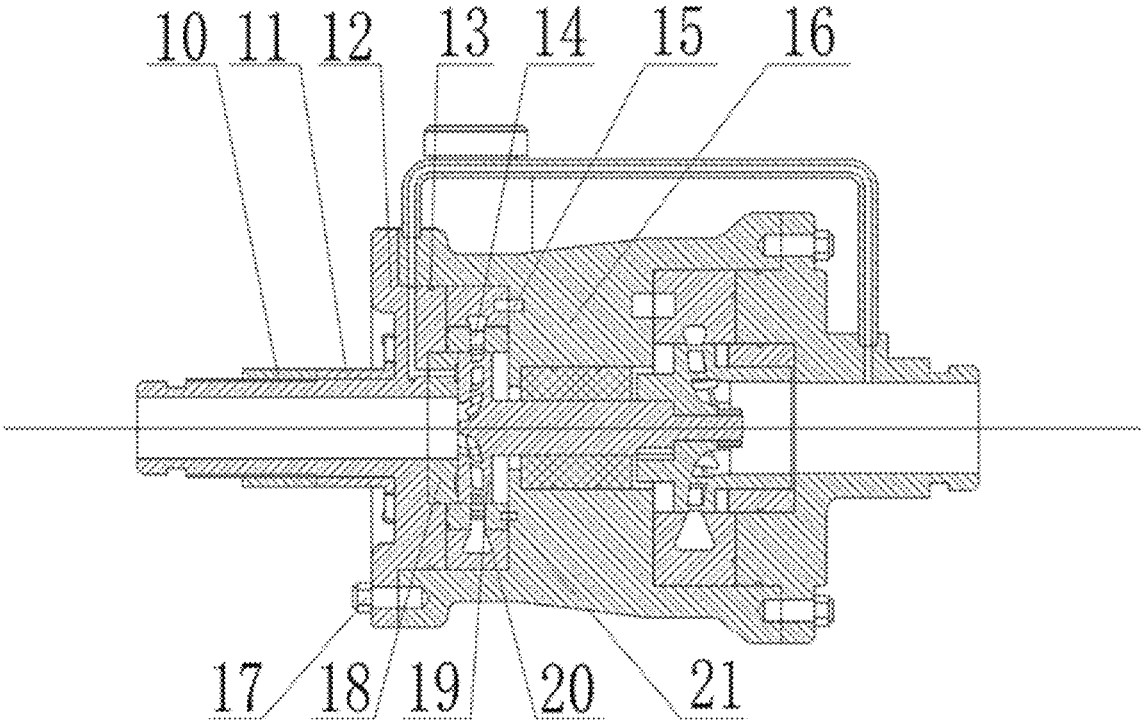
FIG. 8 is a planar sectional view of a turbopump.
Figure 9:
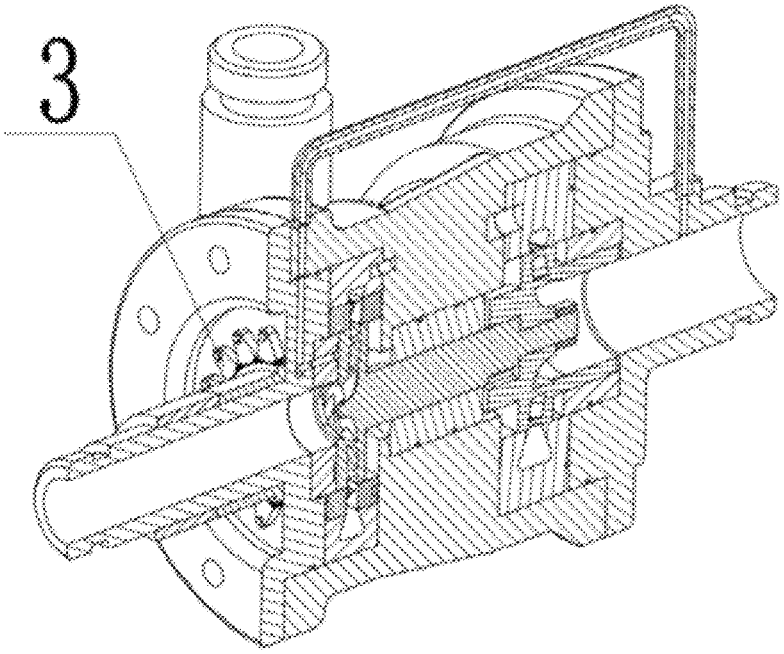
FIG. 9 is a stereo sectional view of a turbopump.

As shown in FIG. 8 and FIG. 9, a turbopump with the rotating guide vane module for hydraulic working condition adjustment comprises a center gear screw cap 10, a center gear 11, a turbine side cover plate 12, a turbine side cover plate sealing ring 13, the rotating guide vane module 14, a turbine volute locating pin hole 15, a device shell 16, bolts 17, an end face friction thrust bearing 18, a turbine impeller 19, a turbine volute module 20, a rotating guide vane locating pin hole 21, rotating guide vane front sealing rings 22, a rotating guide vane back sealing ring 23, a volute diversion block 24, and a turbine side inlet 25.

The device shell 16, the turbine volute module 20, the rotating guide vane module 14, the turbine impeller 19, and the end face friction thrust bearing 18 are sequentially combined from the exterior to the interior. The turbine volute module 20 is inserted into the inner side of the device shell 16. The rotating guide vane module 14 is inserted into the inner side of the turbine volute module 20. The end face friction thrust bearing 18 is located on the outer side of the turbine impeller 19. The turbine impeller 19 and the end face friction thrust bearing 18 form end face friction contact.

As shown in FIG. 6 to FIG. 9, through holes for allowing the penetration of the shafts 9 are formed in the turbine side cover plate 12. The center gear 11 and the center gear screw cap 10 sequentially sleeve the outer wall of an outlet tube on the turbine side cover plate 12 from the interior to the exterior. The center gear screw cap 10 is tube-shaped. The inner wall of the center gear screw cap is threaded. The outer wall of the outlet tube of the turbopump is threaded. The inner wall of the rotating guide vane drive gear 3 has sawteeth, and the center gear 11 and the rotating guide vane drive gear 3 match with each other in a meshing manner. The center gear screw cap 10 is used for fixing the center gear 11.

Figure 5:
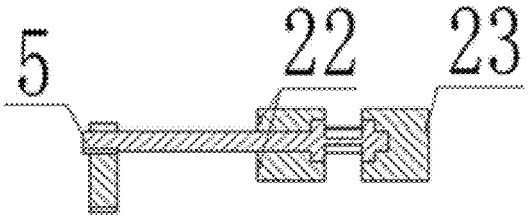
FIG. 5 is a sectional view of a rotating guide vane drive gear and a rotating guide vane.
Figure 6:
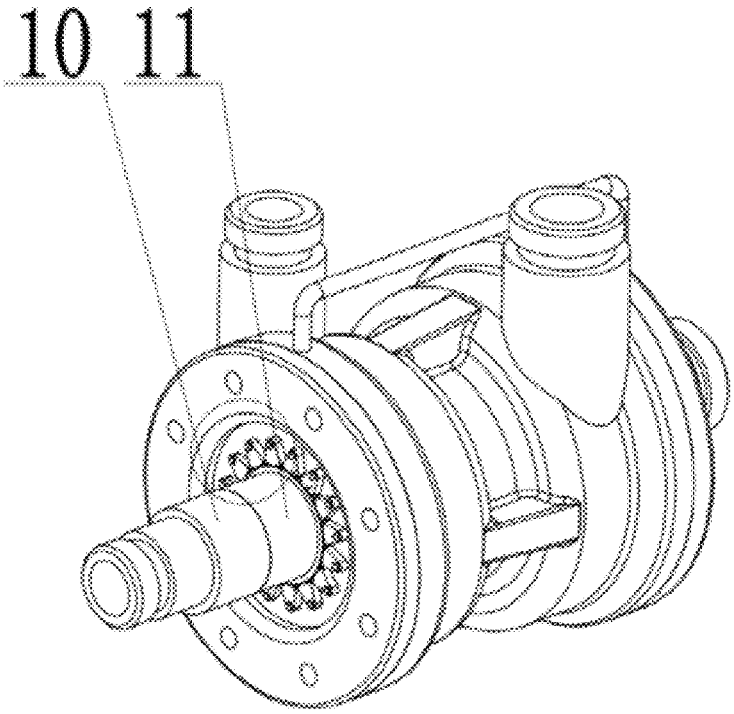
FIG. 6 is a schematic structure diagram showing the overall appearance of a turbopump.
Figure 7:
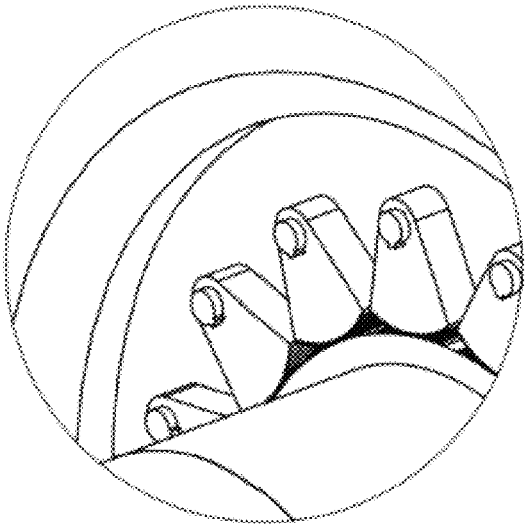
FIG. 7 is an enlarged partial diagram showing meshing of a turbopump center gear and a rotating guide vane drive gear.

As shown in FIG. 5, the rotating guide vane front sealing rings 22 are arranged on the rotating guide vanes 4 and located on the two sides of the through holes in the rotating guide vane front cover plate 2 to prevent the medium from leaking through the through holes.

As shown in FIG. 5, the rotating guide vane back sealing ring 23 is arranged on the rotating guide vane back cover plate 1 to prevent a matching part of the rotating guide vane module 14 and the device shell 16 from leaking.

As shown in FIG. 8 and FIG. 9, the turbine volute locating pin hole 15 is respectively located in the turbine volute module 20 and the device shell 16 to achieve insertion, location and fixation of the turbine volute module 20 by inserting a locating pin.

As shown in FIG. 8 and FIG. 9, the rotating guide vane locating pin hole 21 is respectively located in the rotating guide vane module 14 and the device shell 16 to achieve insertion, location and fixation of the rotating guide vane module 14 by inserting a locating pin.

As shown in FIG. 8, the turbine side cover plate 12 is located and mounted on the device shell 16 through the bolts 17, and the turbine side cover plate sealing ring 13 is arranged on the turbine side cover plate 12 to prevent the medium from leaking.

Figure 10:
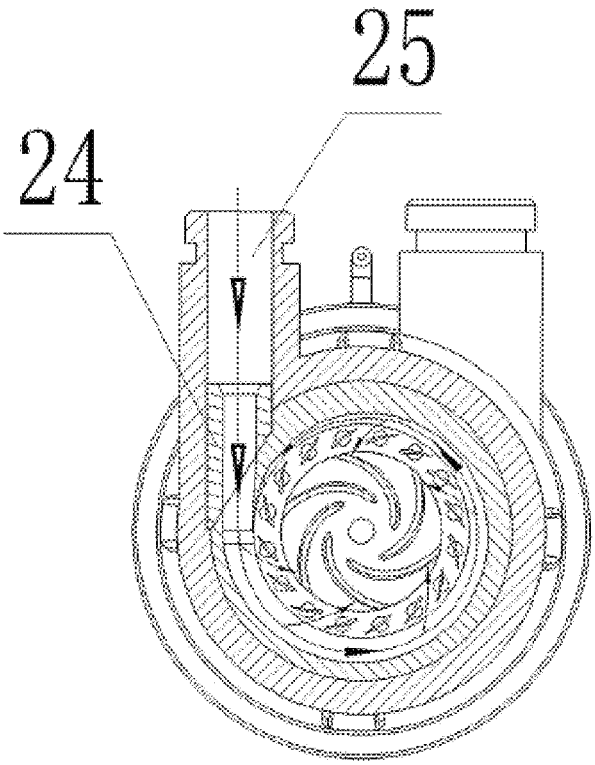
FIG. 10 is a schematic diagram showing the working principle of a rotating guide vane module.
Figure 11:
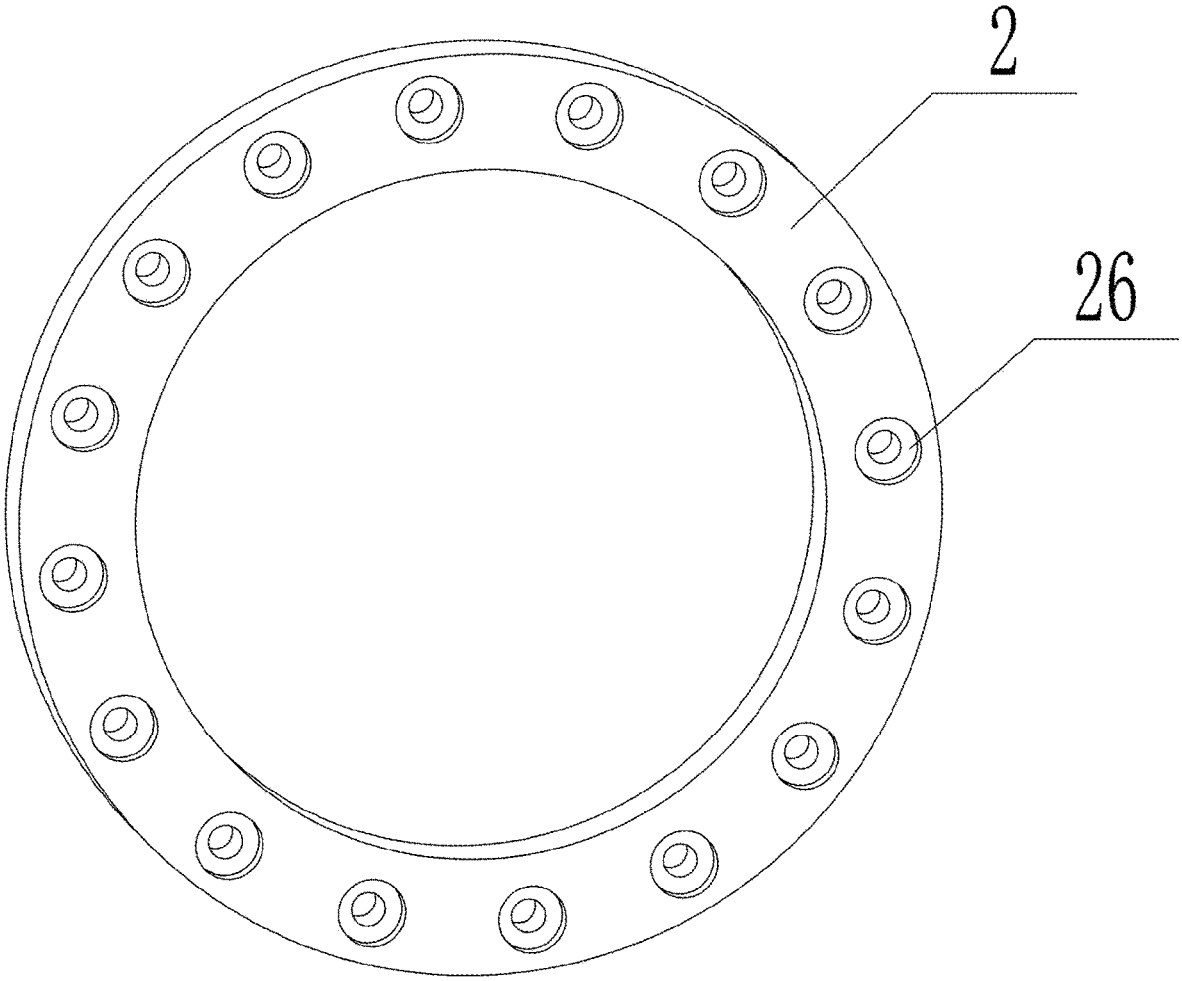
FIG. 11 is a schematic structural diagram of a rotating guide vane front cover plate.

The present invention proposes the rotating guide vane module for hydraulic working condition adjustment and an application method of the module to the turbopump. In an adjusting process, the center gear screw cap 10 is unscrewed; the center gear 11 rotates to drive the rotating guide vane drive gear 3, and then the rotating guide vanes 4 rotate to change their opening degrees. After the adjustment is completed, the center gear screw cap 10 is screwed to press the center gear 11 tightly in order to ensure synchronous fixation of the center gear 11 and the rotating guide vanes 4. As shown in FIG. 10, under a variable working condition, through the turbine side inlet 25, a high-pressure medium sequentially flows through the volute diversion block 24, the turbine volute module 20, and the rotating guide vane module 14 and drives the turbine impeller 19 to generate the power. After decompression, the high-pressure medium flows out through the turbine side outlet.

A method of assembling in a turbopump is also proposed. After the rotating guide vanes 4 are inserted into the rotating guide vane back cover plate 1, the rotating guide vane front cover plate 2 covers them, and sealing rings are respectively mounted in the rotating guide vane front sealing ring 22 and the rotating guide vane back sealing ring 23. So, the rotating guide vane module 14 is formed. Then, the formed rotating guide vane module is inserted into the device shell 16. The rotating guide vane module 14 is located and fixed by inserting the locating pin in the turbine volute locating pin hole 15. The rotating guide vane module 14, the turbine volute module 20, and the preassembled turbine impeller 19 form clearance fit. The end face friction thrust bearing 18 and the turbine side cover plate 12 are mounted in an interference fit manner. The turbine volute module 20 and the device shell 16 are mounted in the interference fit manner. The turbine side cover plate 12 matching with the end face friction thrust bearing 18 is fixed to the device shell 16 through the bolts 17 to ensure that the shafts 9 of the rotating guide vanes 4 penetrate through the preset through holes of the turbine side cover plate 12. Finally, the rotating guide vane drive gear 3 is mounted as follows: the rotating guide vane drive gear 3 is mounted at the ends of the shafts 9 of the turbine side cover plate 12 and is fixedly connected by the rotating guide vane connecting keys 5 in the interference fit manner; the center gear 11 and the rotating guide vane drive gear 3 are mounted in a sawtooth meshing manner; finally, the center gear screw cap 10 is screwed into the turbine outlet tube to press and fix the center gear 11. At this time, the mounting of the rotating guide vane module is completed.

The rotating guide vane module for hydraulic working condition adjustment and the method of assembling in a turbopump proposed by the present invention can be applied to the reverse osmosis seawater desalination system. The present invention can not only adjust the working condition without changing the device, but also expand the high efficiency area when applied to multiple working conditions.

The above merely describes preferred embodiments of the present invention, but are not used to limit the present invention in any forms. Although the present invention has been disclosed by the above preferred embodiments, but the preferred embodiments do not constitute a limitation on the present invention. A person skilled in the art can utilize the above-mentioned technical content to do some changes or improvements as the equivalently-changed equivalent embodiments without departing from the scope of the technical solutions of the present invention. Any simple modifications, equivalent changes and improvements within the technical essential range of the present invention without departing from the content of the technical solutions of the present invention shall be all contained in the scope of the technical solutions of the present invention.

What is claimed is:

1. A turbopump with a rotating guide vane module for hydraulic working condition adjustment, the rotating guide vane module for hydraulic working condition adjustment comprising a rotating guide vane module (14), wherein the rotating guide vane module (14) comprises a rotating guide vane back cover plate (1), a rotating guide vane front cover plate (2), a rotating guide vane drive gear (3), and rotating guide vanes (4); the rotating guide vane back cover plate (1) is ring-shaped, and the rotating guide vane front cover plate (2) is ring-shaped;

each rotating guide vane (4) is an integrally-formed independent component and comprises a rotating guide vane back seat (6), a blade (7), a rotating guide vane front seat (8), and a shaft (9); the rotating guide vane back seat (6) and the rotating guide vane front seat (8) are cylindrical; the blade (7) is sheet-shaped; the blade (7) is located between the rotating guide vane back seat (6) and the rotating guide vane front seat (8); the shaft (9) is connected with the rotating guide vane front seat (8); the central axis of the rotating guide vane back seat (6), the central axis of the rotating guide vane front seat (8), and the central axis of the shaft (9) are coaxial;

a first slot for mounting the rotating guide vanes (4) is formed in the rotating guide vane back cover plate (1); second slots (26) for matching with the mounting of the rotating guide vane front seats (8) and through holes for allowing the penetration of the shafts (9) are formed in the rotating guide vane front cover plate (2); the rotating guide vane drive gear (3) is located at the end parts of the shafts (9); a keyslot is formed in each shaft (9), and a rotating guide vane connecting key (5) is inserted into the keyslot; the rotating guide vane drive gear (3) is connected with the shafts (9) through the keyslots and the rotating guide vane connecting keys (5), wherein the turbopump comprises a center gear screw cap (10), a center gear (11), a turbine side cover plate (12), a turbine side cover plate sealing ring (13), the rotating guide vane module (14), a turbine volute locating pin hole (15), a device shell (16), bolts (17), an end face friction thrust bearing (18), a turbine impeller (19), a turbine volute module (20), a rotating guide vane locating pin hole (21), rotating guide vane front sealing rings (22), a rotating guide vane back sealing ring (23), a volute diversion block (24), and a turbine side inlet (25);

wherein the device shell (16), the turbine volute module (20), the rotating guide vane module (14), the turbine impeller (19), and the end face friction thrust bearing (18) are sequentially combined from the exterior to the interior; the turbine volute module (20) is inserted into an inner side of the device shell (16); the rotating guide vane module (14) is inserted into an inner side of the turbine volute module (20); the end face friction thrust bearing (18) is located on the outer side of the turbine impeller (19); the turbine impeller (19) and the end face friction thrust bearing (18) form end face friction contact.

2. The turbopump with the rotating guide vane module for hydraulic working condition adjustment according to claim 1, wherein through holes for allowing the penetration of the shafts (9) are formed in the turbine side cover plate (12); the center gear (11) and the center gear screw cap (10) sequentially sleeve the outer wall of an outlet tube on the turbine side cover plate (12) from the interior to the exterior; the center gear screw cap (10) is tube-shaped; the inner wall of the center gear screw cap (10) is threaded, the outer wall of the outlet tube of the turbopump is threaded, the inner wall of the rotating guide vane drive gear (3) has sawteeth, and the center gear (11) and the rotating guide vane drive gear (3) match with each other in a meshing manner.

3. The turbopump with the rotating guide vane module for hydraulic working condition adjustment according to claim 2, wherein the rotating guide vane front sealing rings (22) are arranged on the rotating guide vanes (4) and located on the two sides of the through holes in the rotating guide vane front cover plate (2);

the rotating guide vane back sealing ring (23) is arranged on the rotating guide vane back cover plate (1);

the turbine volute locating pin hole (15) is respectively located in the turbine volute module (20) and the device shell (16);

the rotating guide vane locating pin hole (21) is respectively located in the rotating guide vane module (14) and the device shell (16);

the turbine side cover plate (12) is located and mounted on the device shell (16) through the bolts (17), and the turbine side cover plate sealing ring (13) is arranged on the turbine side cover plate (12).

4. A method of assembling the turbopump with the rotating guide vane module for hydraulic working condition adjustment according to claim 1, wherein in an adjusting process, the center gear (11) screw cap (10) is unscrewed; the center gear rotates to drive the rotating guide vane drive gear (3), and then the rotating guide vanes (4) rotate to change their opening degrees;

after the adjustment is completed, the center gear screw cap (10) is screwed to press the center gear (11) tightly in order to ensure synchronous fixation of the center gear (11) and the rotating guide vanes (4).

5. A method of assembling the turbopump with the rotating guide vane module for hydraulic working condition adjustment according to claim 2, wherein in an adjusting process, the center gear (11) screw cap (10) is unscrewed;

the center gear rotates to drive the rotating guide vane drive gear (3), and then the rotating guide vanes (4) rotate to change their opening degrees;

after the adjustment is completed, the center gear screw cap (10) is screwed to press the center gear (11) tightly in order to ensure synchronous fixation of the center gear (11) and the rotating guide vanes (4).

6. A method of assembling the turbopump with the rotating guide vane module for hydraulic working condition adjustment according to claim 3, wherein in an adjusting process, the center gear (11) screw cap (10) is unscrewed; the center gear rotates to drive the rotating guide vane drive gear (3), and then the rotating guide vanes (4) rotate to change their opening degrees;

after the adjustment is completed, the center gear screw cap (10) is screwed to press the center gear (11) tightly in order to ensure synchronous fixation of the center gear (11) and the rotating guide vanes (4).

* * * * *